US011124378B2

(12) United States Patent
Kasuya et al.

(10) Patent No.: US 11,124,378 B2
(45) Date of Patent: Sep. 21, 2021

(54) SHEET DISCHARGING APPARATUS AND IMAGE FORMING APPARATUS

(71) Applicant: CANON KABUSHIKI KAISHA, Tokyo (JP)

(72) Inventors: Yoshisuke Kasuya, Susono (JP); Kenichirou Isobe, Yokohama (JP); Hirotaka Ishii, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/903,426

(22) Filed: Jun. 17, 2020

(65) Prior Publication Data

US 2021/0002097 A1 Jan. 7, 2021

(30) Foreign Application Priority Data

Jul. 3, 2019 (JP) ..... JP2019-124830

(51) Int. Cl.

| | |
|---|---|
| ***B65H 29/70*** | (2006.01) |
| ***G03G 15/00*** | (2006.01) |
| ***B65H 29/12*** | (2006.01) |
| ***B65H 29/14*** | (2006.01) |

(52) U.S. Cl.

CPC ..... *B65H 29/70* (2013.01); *B65H 29/125* (2013.01); *B65H 29/14* (2013.01); *G03G 15/6529* (2013.01); *G03G 15/6552* (2013.01)

(58) Field of Classification Search

CPC ..... B65H 29/70; B65H 29/125; B65H 29/14; B65H 29/60; B65H 29/58; B65H 31/02; B65H 31/20; B65H 31/24; B65H 2408/1121; B65H 2405/332; B65H 2405/1114; B65H 2405/11164

USPC ..... 271/221

See application file for complete search history.

(56) References Cited

U.S. PATENT DOCUMENTS

| | | | | |
|---|---|---|---|---|
| 5,152,513 A * | 10/1992 | Ogasawara | ..... | B65H 15/00 271/3.07 |
| 6,196,542 B1 * | 3/2001 | Allmendinger | ..... | B65H 29/38 271/189 |
| 8,152,163 B2 * | 4/2012 | Kitan | ..... | B65H 29/70 271/207 |

(Continued)

FOREIGN PATENT DOCUMENTS

| | | |
|---|---|---|
| JP | 2010-155681 A | 7/2010 |
| JP | 2014-43289 A | 3/2014 |
| JP | 2017-77941 A | 4/2017 |

*Primary Examiner* — Thomas A Morrison
(74) *Attorney, Agent, or Firm* — Venable LLP

(57) ABSTRACT

A sheet discharging apparatus includes a discharge portion including a first member configured to apply a force to a first region of a sheet from an upper surface and a second member configured to apply a force to a second region of the sheet from a lower surface, and a contact portion including a first guide surface disposed contactably with the first region and a second guide surface disposed contactably with the second region. The first guide surface is formed such that an angle with respect to a tangential line at a contact point between the first member and the first region of the sheet becomes a first angle. The second guide surface is formed such that an angle with respect to a tangential line at a contact point between the second member and the second region of the sheet becomes a second angle which is smaller than the first angle.

9 Claims, 12 Drawing Sheets

(56) References Cited

U.S. PATENT DOCUMENTS

| | | | | |
|---|---|---|---|---|
| 10,399,810 | B2 | 9/2019 | Agata | |
| 2005/0035535 | A1* | 2/2005 | Ogata | B65H 43/02 271/220 |
| 2017/0355541 | A1* | 12/2017 | Koyama | B65H 31/10 |

* cited by examiner

SHEET DISCHARGING APPARATUS AND IMAGE FORMING APPARATUS

BACKGROUND OF THE INVENTION

Field of the Invention

The present invention relates to a sheet discharging apparatus and to an image forming apparatus comprising the same.

Description of the Related Art

In order to stably discharge and stack sheets onto a sheet discharge tray in an image forming apparatus capable of continuously feeding the sheets, the sheets to be discharged are stiffened in such image forming apparatus. As such image forming apparatus, there is one provided with a flag member for dropping the discharged sheets onto the sheet discharge tray. For instance, Japanese Patent Application Laid-open No. 2017-77941 discloses one provided with a flag member that discharges sheets while applying wavy flexion along a width direction orthogonal to a sheet discharge direction and that has an inclined surface inclined with an angle along a surface of the sheet to be discharged.

Japanese Patent Application Laid-open No. 2017-77941 applies forces to the sheet alternately in the width direction from a surface and a back of the sheet in order to give the wavy flexion. Due to that, a discharge angle of the sheet differs widthwise at part to which the force is applied from the surface and at part where the force is applied from the back. However, because an angle of the inclined surface with respect to a horizontal plane of the flag member is constant, there is a case where an impact applied to a tip of the sheet becomes great when the sheet comes into contact with the flag member at part where the discharge angle is large.

SUMMARY OF THE INVENTION

According to a first aspect of the present invention, a sheet discharging apparatus, includes a sheet discharge tray onto which a sheet discharged out of an apparatus body is stacked, a discharge portion configured to discharge the sheet in a flexed state, the discharge portion including a first member configured to apply a force to a first region of the sheet from an upper surface of the sheet and a second member disposed at a position different from a position of the first member in a width direction orthogonal to a discharge direction of the sheet such that at least a part thereof overlaps with the first member when viewed in the width direction and configured to apply a force to a second region of the sheet from a lower surface of the sheet, and a contact portion including a first guide surface disposed contactably with the first region of the sheet and configured to guide the sheet discharged out of the discharge portion toward the sheet discharge tray and a second guide surface disposed contactably with the second region of the sheet and configured to guide the sheet discharged out of the discharge portion toward the sheet discharge tray, the contact portion moving from a standby position by being pressed by the sheet. The first guide surface is formed such that an angle with respect to a tangential line at a contact point between the first member and the first region of the sheet becomes a first angle when viewed in the width direction in a state in which the contact portion is located at the standby position. The second guide surface is formed such that an angle with respect to a tangential line at a contact point between the second member and the second region of the sheet becomes a second angle which is smaller than the first angle when viewed in the width direction in a state in which the contact portion is located at the standby position.

According to a second aspect of the present invention, a sheet discharging apparatus, includes a sheet discharge tray on which a sheet discharged out of an apparatus body is stacked, a discharge portion configured to discharge the sheet in a flexed state, the discharge portion including a first member configured to apply a force to a first region of the sheet from an upper surface of the sheet and a second member disposed at a position different from a position of the first member in a width direction orthogonal to a discharge direction of the sheet such that at least a part thereof overlaps with the first member when viewed in the width direction and configured to apply a force to a second region of the sheet from a lower surface of the sheet, and a contact portion including a first guide surface disposed contactably with the first region of the sheet and configured to guide the sheet discharged out of the discharge portion toward the sheet discharge tray and a second guide surface disposed contactably with the second region of the sheet and configured to guide the sheet discharged out of the discharge portion toward the sheet discharge tray, the contact portion moving from a standby position by being pressed by the sheet. The first guide surface is formed such that an angle with respect to a horizontal plane becomes a third angle when viewed in the width direction in a state in which the contact portion is located at the standby position. The second guide surface is formed such that an angle with respect to the horizontal plane becomes a fourth angle which is smaller than the third angle when viewed in the width direction in a state in which the contact portion is located at the standby position.

Further features of the present invention will become apparent from the following description of exemplary embodiments with reference to the attached drawings.

DESCRIPTION OF THE EMBODIMENTS

First Embodiment

Overall Configuration of Image Forming Apparatus

Figure 1:
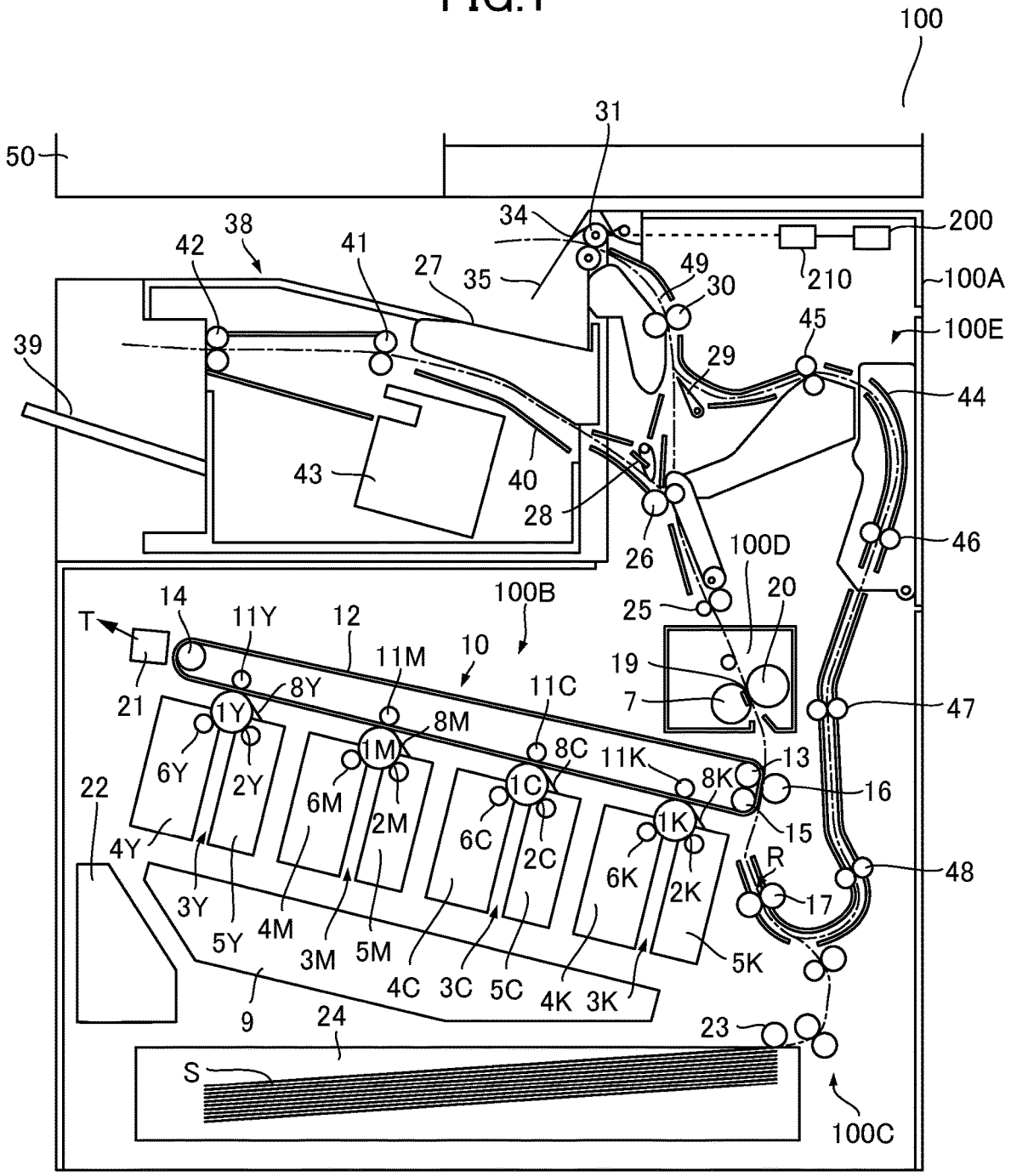
FIG. 1 is a schematic diagram illustrating a configuration of an image forming apparatus of a first exemplary embodiment of the present disclosure.

Exemplary embodiments of the present disclosure will be described below with reference to the drawings. Note that same components will be denoted by same reference numerals and an overlapped description will be omitted. FIG. 1 is a section view schematically illustrating a configuration of the image forming apparatus 100 of the present exemplary embodiment of the present disclosure. In the present disclosure, an electro-photographic color laser beam printer having a function of forming images on both surfaces of a sheet S will be described as one example of the image forming apparatus 100. As illustrated in FIG. 1, the image forming apparatus 100 includes an image forming unit 100B, a feed unit 100C, a fixing unit 100D, a duplex conveyance unit 100E, a control portion 200 and an actuator 210 such as a motor serving as a driving unit of the present exemplary embodiment.

Note that it is construed that sizes, materials and shapes of component parts, their relative disposition and the like described in the embodiments of the present disclosure are not limited only to the scope described in the embodiments unless otherwise specifically described. Still further, configurations of the embodiments of the present disclosure are not limited only to the color laser beam printer and may be applicable also to other image forming apparatuses such as a copier, a facsimile machine and the like. Still further, as for an image forming method, the embodiments of the present disclosure are applicable also to an image forming apparatus using an inkjet system for example other than the electro-photographic image forming system.

Configuration of Image Forming Unit

The image forming unit 100B serving as an image forming unit of the embodiments of the present disclosure includes process cartridges 3Y, 3M, 3C and 3K removably attached to an apparatus body 100A. Even though these four process cartridges 3Y, 3M, 3C and 3K are different in terms of forming toner images of yellow (Y), magenta (M), cyan (C) and black (k), they have the same structures. Due to that, the yellow process cartridge 3Y will be typically described and description of other process cartridges will be omitted in the present disclosure. The process cartridge 3Y is constituted of a developing unit 4Y and a cleaner unit 5Y. The developing unit 4Y includes a developing roller 6Y. Meanwhile, the cleaner unit 5Y includes a photosensitive drum 1Y serving as an image bearing member, a charging roller 2Y, a drum cleaning blade 8Y and a waste toner container. Disposed right under the process cartridge 3Y is a scanner unit 9 that exposes the photosensitive drum 1Y with light based on image signals. After charging the photosensitive drum 1Y to a predetermined negative polarity by the charging roller 2Y, an electrostatic latent image is formed on the photosensitive drum 1Y by the scanner unit 9. Negative toner is attached to the electrostatic latent image which has been reversely developed by the developing unit 4Y. Thus, toner images of yellow, magenta, cyan and black are formed respectively on surfaces of the photosensitive drums 1Y, 1M, 1C and 1K.

The intermediate transfer belt unit 10 includes an intermediate transfer belt 12 stretched by a driving roller 13 and a tension roller 14. The tension roller 14 applies a tension to the intermediate transfer belt 12 in a direction of an arrow T in FIG. 1. The photosensitive drum 1Y rotates clockwise in FIG. 1 and the intermediate transfer belt 12 rotates counterclockwise in FIG. 1. Disposed inside of the intermediate transfer belt 12 at a position facing the photosensitive drum 1Y through the intermediate transfer belt 12 is a primary transfer roller 11Y. The primary transfer roller 11Y applies a transfer bias by a bias application portion not illustrated. Due to the transfer bias from the primary transfer roller 11Y, the toner images on the photosensitive drums 1Y, 1M, 1C and 1K are sequentially and primarily transferred onto the intermediate transfer belt 12. The four toner images are conveyed, while being superimposed with each other, to a secondary transfer portion 15. Then, a positive bias is applied to a secondary transfer roller 16 to transfer the four color toner images on the intermediate transfer belt 12 onto the sheet S conveyed to the secondary transfer portion 15. After transferring the toner images, toners left on the photosensitive drums 1Y, 1M, 1C and 1K are removed by drum cleaning blades 8Y, 8M, 8C and 8K, respectively. Toner left on the intermediate transfer belt 12 after the secondary transfer onto the sheet S is removed by a belt cleaning unit 21 and is collected into a waste toner collecting container 22.

Configuration of Feeding Unit

The feed unit 100C includes a feed roller 23 mounted to the apparatus body 100A and a feed cassette 24 removably attached to the apparatus body 100A. The feed roller 23 is rotated by a driving force of a feed driving unit not illustrated. The feed driving unit is fixed to the apparatus body 100A and includes a driving mechanism such as a gear. The feed roller 23 separates and conveys the sheet S fed from the feed cassette 24 one by one by the driving force of the feed driving unit. The sheet S fed from the feed cassette 24 is then conveyed to a nip portion R of the registration roller pair 17 being stopped such that a leading edge in a conveyance direction, i.e., a downstream edge in the conveyance direction, of the sheet S butts against and is received by the nip portion R. Then, a skew of the sheet S is corrected and a timing of conveyance of the sheet S is adjusted with an image forming process of the image forming unit 100B by the registration roller pair 17. The sheet S fed from the feed unit 100C is conveyed by the registration roller pair 17 to the secondary transfer portion 15.

Configuration of Fixing Unit

The fixing unit 100D heats the toner image which has been transferred onto the sheet S to fix to the sheet S. The fixing unit 100D includes a heater 7, a heating roller 19 serving as a fixing member to be heated by the heater 7 and a pressure roller 20 serving as a pressing member that rotates while being in pressure contact with the heating roller 19. The sheet S is guided to an input guide portion and is introduced into a fixing nip portion formed by the heating roller 19 and the pressure roller 20. Then, heat and pressure are applied to the sheet S by being nipped and conveyed at the fixing nip portion. Thereby, the toner image of the plurality of colors is melted and is blended to be fixed on the surface of the sheet S as a full-color image. The sheet S conveyed from the image forming apparatus 100D is lifted up by conveyance roller pairs 25 and 26 toward an upper part of the apparatus body 100A.

Configuration of Discharge Tray and Stacking Tray

According to the present exemplary embodiment, a post-processing unit 38 is disposed within a hollow space between the apparatus body 100A and an image scanner 50, and a sheet discharge tray 27 and a stacking tray 39 are disposed, respectively, on an upper surface side and on a side surface side of the post-processing unit 38. In a case where the sheet S is to be discharged onto the sheet discharge tray 27, the sheet S is conveyed to a sheet discharge roller pair 31 by passing through a conveyance roller pair 30 by being guided by distributing guide members 28 and 29. Then, the sheet S is brought in contact with an anti-static brush 34 by the sheet discharge roller pair 31 and is discharged onto the sheet discharge tray 27 while flipping up a flag member 35 serving as a contact portion of the present exemplary embodiment. Thus, the sheet discharging apparatus of the present exemplary embodiment included in the present disclosure is constituted of the sheet discharge tray 27 serving as a stacking portion, the sheet discharge roller pair 31 serving as a discharge portion and the flag member 35 serving as the contact portion. Still further, a sheet discharging apparatus of a third exemplary embodiment includes a sheet member 52 (see FIG. 9) instead of the flag member 35 serving as the contact portion. Note that in a case where the sheet S is to be discharged onto the stacking tray 39, the sheet S is guided by the distributing guide member 28 to be conveyed to a conveyance path 40 within the post-processing unit 38. Then, the sheet S is conveyed to a discharge roller pair 42 by passing through a conveyance roller pair 41 and is discharged onto the stacking tray 39 on the side surface of the post-processing unit 38. At this time, the sheet S on which a post-processing is to be implemented is conveyed to the discharge roller pair 42 after implementing the post-processing in the post-processing unit 38 by a post-processing portion 43 on a way of the conveyance and is discharged onto the stacking tray 39 by the discharge roller pair 42.

Configuration of Duplex Conveyance Unit

The duplex conveyance unit 100E is constituted of the sheet discharge roller pair 31, a duplex conveyance path 44 and duplex conveyance roller pairs 45, 46, 47 and 48. In a case where images are to be formed on both surfaces, i.e., on first and second surfaces, of the sheet S, conveyance of the sheet S is controlled as follow. At first, the sheet S on which an image has been formed on the first surface thereof is conveyed toward the sheet discharge roller pair 31. Then, after passing through the distributing guide member 29, the sheet discharge roller pair 31 is controlled to rotate inversely on a timing in which a trailing edge of the sheet S, i.e., an upstream edge of the sheet S in the conveyance direction, comes to a predetermined position where the trailing edge has not passed through a nip portion of the sheet discharge roller pair 31. Thereby, the sheet S on which the image has been formed on the first surface thereof is switched back and is conveyed toward the apparatus body 100A. The switched back sheet S enters the duplex conveyance path 44 by passing through an upper side of the distributing guide member 29. After that, the sheet S is led to the duplex conveyance roller pair 45. Then, the sheet S is conveyed sequentially through the duplex conveyance paths 46, 47 and 48 and is conveyed again to the registration roller pair 17 while being upside down. Then, a skew of the sheet S is corrected and a timing of conveyance of the sheet S is adjusted with an image forming process of the image forming unit 100B by the registration roller pair 17 in the same manner with the case of forming the image on the first surface of the sheet S. Then, a four color toner image is secondarily transferred onto the second surface of the sheet S at the secondary transfer portion 15. After that, the sheet S is introduced again to the fixing unit 100D and the sheet S in which the images have been formed on the both surfaces is discharged onto the sheet discharge tray 27 or onto the stacking tray 39.

Hitherto, there is a printer that includes a mechanism of discharging a sheet while stiffening the sheet by disposing rollers in a comb shape or by providing a flange portion around a roller in order to stably discharge and stack the sheet on a tray. As such a printer, there is one provided with a pivotally supported flag member in a vicinity downstream of a roller in a sheet conveyance direction. It is possible to drop the sheet discharged by the flag member onto the tray and to detect the sheet discharged onto the tray or the sheets stacked on the tray in such a printer. The image forming apparatus 100 of the present disclosure is also provided with such configuration of dropping the sheet S discharged out of the sheet discharge roller pair 31 onto the sheet discharge tray 27 to stack on the sheet discharge tray 27.

Configuration of Flag Member

Figure 2A:
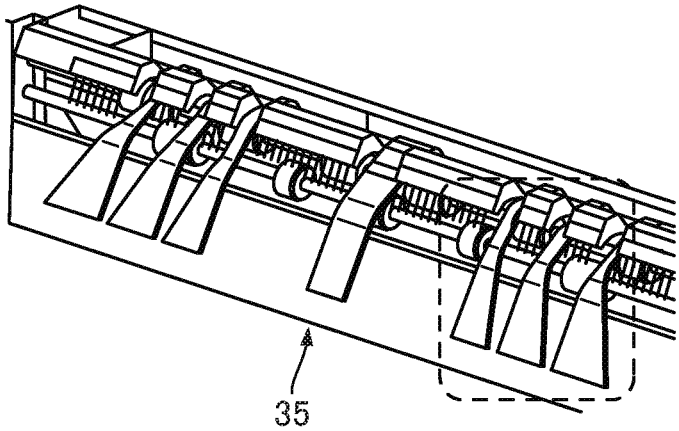
FIG. 2A is a perspective view illustrating a flag member of the first exemplary embodiment.
Figure 2B:
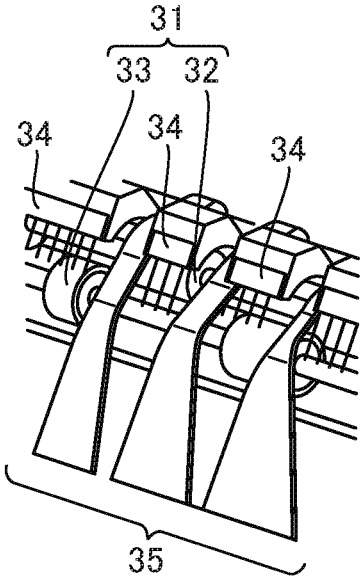
FIG. 2B is an enlarged view illustrating a sheet discharge roller pair and the flag member.
Figure 2C:
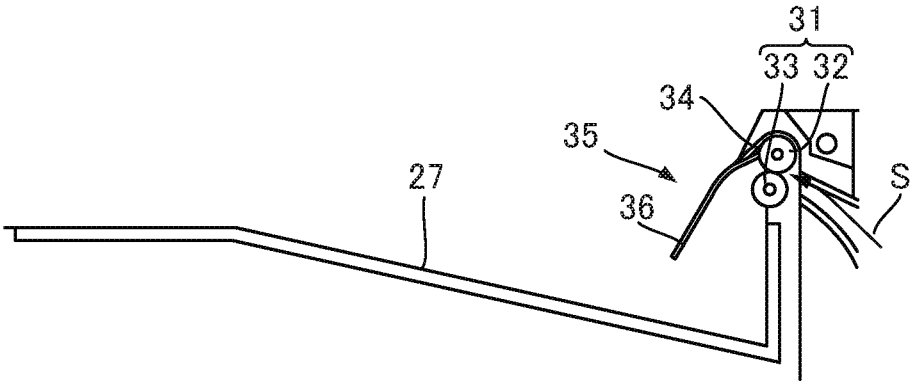
FIG. 2C is a side view illustrating a sheet discharge tray and the flag member.

The configuration of the flag member 35 of the present exemplary embodiment of dropping the sheet S discharged out of the sheet discharge roller pair 31 onto the sheet discharge tray 27 to stack on the sheet discharge tray 27 will be described below. FIG. 2A is a perspective view of the flag member 35, FIG. 2B is an enlarged view illustrating the sheet discharge roller pair 31 and the flag member 35 and FIG. 2C is a side view of the sheet discharge tray 27 and the flag member 35. The sheet discharge roller pair 31 is provided as the discharge portion for discharging the sheet S onto the sheet discharge tray 27 in the present exemplary embodiment. The sheet discharge roller pair 31 is composed of a discharge upper roller portion 32 coming into contact with the sheet S from an upper surface of the sheet S and a discharge lower roller portion 33 coming into contact with the sheet S from a lower surface of the sheet S. The anti-static brush 34 is also provided in a vicinity of the sheet discharge roller pair 31 to destaticize the sheet S when the sheet S discharged out of the sheet discharge roller pair 31 comes into contact with the anti-static brush 34. The sheet S discharged out of the sheet discharge roller pair 31 is dropped onto the sheet discharge tray 27 by coming into contact with the flag member 35 and is stacked on the sheet discharge tray 27. The flag member 35 includes a pivot shaft 35*a* (see FIGS. 4A through 4C) that is pivotably supported by the apparatus body 100A and that pivots and moves from a standby position as the pivot shaft 35*a* is pressed by the sheet S coming into contact with the pivot shaft 35*a* when the sheet S is discharged out of the sheet discharge roller pair 31. A position of the flag member 35 in a state in which no sheet is in contact with the flag member 35 will be referred to as the standby position in the present exemplary embodiment. The flag member 35 includes a sensor 37 (see FIGS. 4A through 4C) serving as a detection portion for detecting that the sheet S has been discharged out of the sheet discharge roller pair 31 and that the sheets stacked on the sheet discharge tray 27 have come to an upper loading limit, i.e., a full load condition.

Configuration of Discharge Roller Pair

Figure 3:
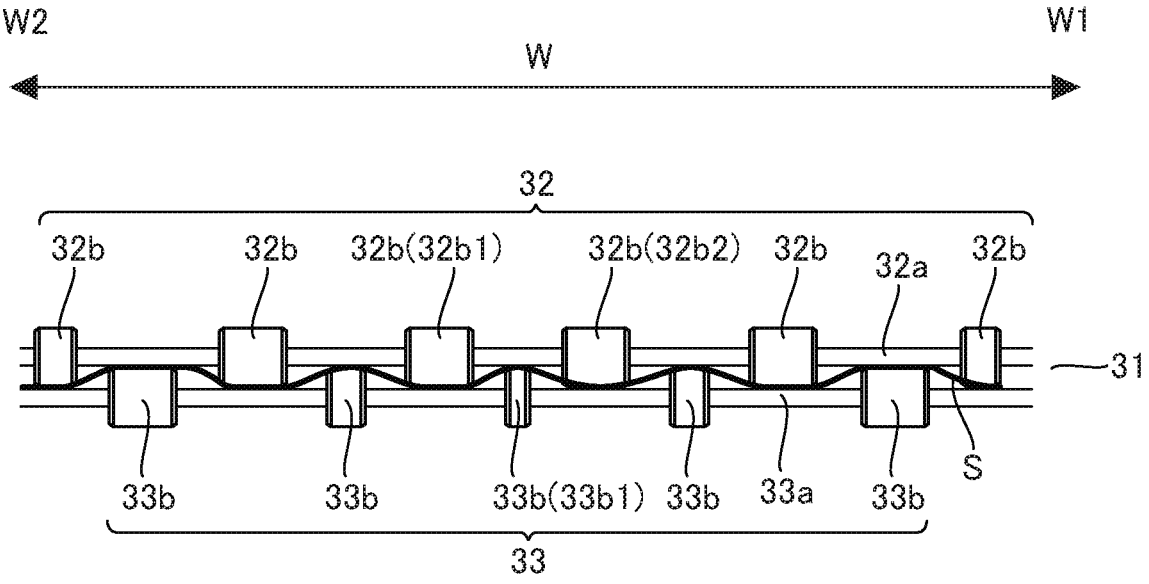
FIG. 3 illustrates a sheet discharge roller pair of the first exemplary embodiment.

Next, a configuration of the sheet discharge roller pair 31 will be described with reference to FIG. 3. FIG. 3 illustrates the sheet discharge roller pair 31 serving as the discharge portion of the present exemplary embodiment. The sheet discharge roller pair 31 includes the discharge upper roller portion 32 and the discharge lower roller portion 33. When the sheet S is to be discharged, the discharge lower roller portion 33 is rotated by an actuator 210. Then, as gears not illustrated and provided at end portions of the discharge upper roller portion 32 and the discharge lower roller portion 33 engage with each other, the rotation of the discharge lower roller portion 33 is transmitted to the discharge upper roller portion 32 and the sheet S is discharged out of the sheet discharge roller pair 31. Accordingly, the discharge upper roller portion 32 rotates following the rotation of the discharge lower roller portion 33 and the sheet S conveyed by the sheet discharge roller pair 31 is thus discharged. While the configuration in which the discharge lower roller portion 33 is rotated by the actuator 210 (see FIG. 1) is adopted in the present exemplary embodiment, the discharge upper roller portion 32 may be also rotated by the actuator 210.

The discharge upper roller portion 32 includes a first pivot shaft 32*a* and a plurality of cylindrical first rollers 32*b* rotatably supported by the first pivot shaft 32*a*. The discharge lower roller portion 33 includes a second pivot shaft 33*a* and a plurality of cylindrical second rollers 33*b* rotatably supported by the second pivot shaft 33*a*. Thus, the sheet discharge roller pair 31 is composed of the plurality of first rollers 32*b* fixed to the first pivot shaft 32*a* and the plurality of second rollers 32*b* fixed to the second pivot shaft 33*a*. The first roller 32*b* is a first member that includes an outer circumferential surface coming into contact with the discharged sheet S from the upper surface of the sheet S and that applies a force for discharging the sheet S. The second roller 33*b* is a second member that includes an outer circumferential surface coming into contact with the sheet S from the lower surface of the sheet S and that applies a force for discharging the sheet S. Still further, in a case where a second roller 33*b*1 is defined as the second member, a first roller 32*b*2 which is disposed on a side opposite widthwise from the first roller 32*b*1 serving as the first member and which includes an outer circumferential surface coming into contact with the sheet S being discharged is a third roller of the present exemplary embodiment. The first and second rollers 32*b* and 33*b* are disposed respectively at predetermined intervals in a comb shape such that the first and second rollers 32*b* and 33*b* do not face at widthwise same positions. Accordingly, the sheet discharge roller pair 31 is composed of the first and second rollers 32*b* and 33*b* disposed at widthwise different positions across the sheet S. Still further, the first and second rollers 32*b* and 33*b* are disposed at positions where at least parts of their outer diameters overlap with each other when viewed in the width direction. Note that the width direction of the present exemplary embodiment indicates a direction orthogonal to a discharge direction of the sheet S, i.e., a direction indicated by a direction W. Still further, a sight direction when 'viewed in the width direction' is a direction W when viewed such that W1 comes to a front side and W2 comes to a back side. At this time, because the discharge direction of the sheet S is a direction orthogonal to an axial direction of the first pivot shaft 32*a*, the direction W which is the sight direction when viewed in the width direction is also a sight direction in parallel with the axial direction of the first pivot shaft 32*a*. By such arrangement, the sheet S deflects wavily in the width direction and is discharged, while being stiffened, with a predetermined elevation angle with respect to a horizontal plane by the first and second rollers 32*b* and 33*b* disposed as described above.

Figure 4A:
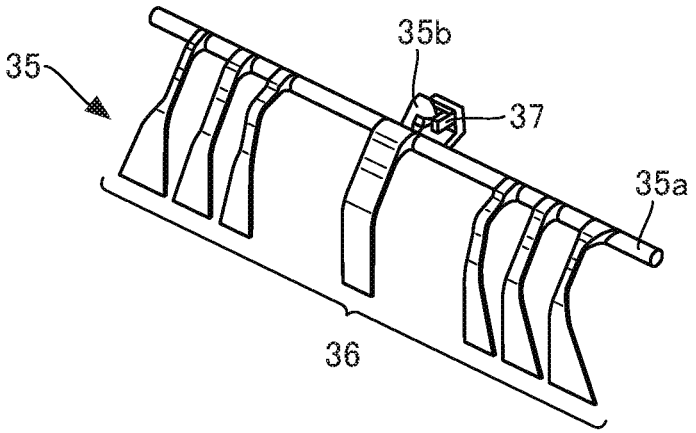
FIG. 4A is a perspective view illustrating the flag member.
Figure 4B:
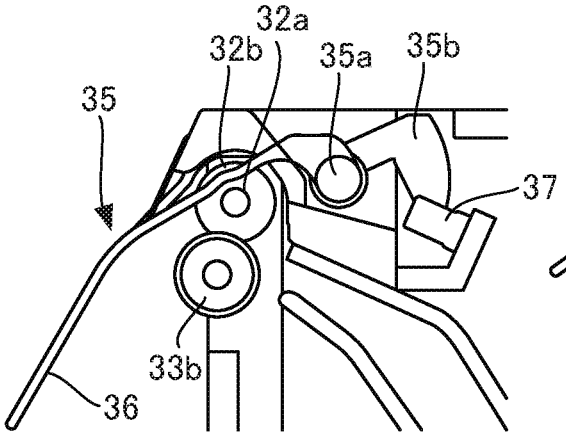
FIG. 4B is a section view illustrating the flag member in a state in which a sensor is in a light transmitting state.
Figure 4C:
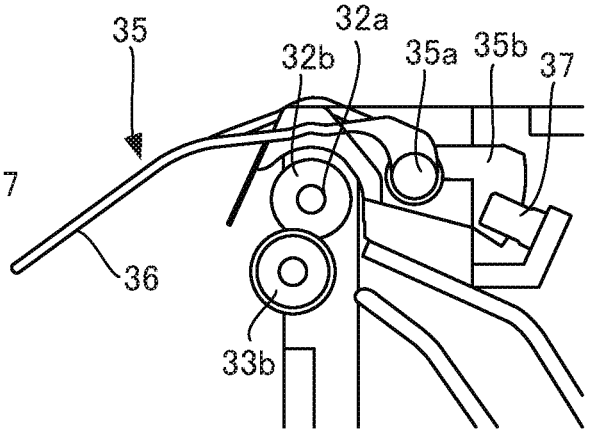
FIG. 4C is a section view illustrating the flag member in a state in which a sensor is in a light shielding state.

Next, a configuration of the flag member 35 will be described with reference to FIGS. 4A, 4B and 4C. FIG. 4A is a perspective view illustrating the flag member 35, FIG. 4B is a section view of the flag member 35 when the sensor 37 is put in a light transmitting state and FIG. 4C is a section view of the flag member 35 when the sensor 37 is put in a light shielding state. As illustrated in FIG. 4A, the flag member 35 includes the pivot shaft 35*a*, a sensor flag member 35*b* and a plurality of flag portions 36. The pivot shaft 35*a* is pivotably supported by the apparatus body 100A (see FIG. 1). Each of the flag portions 36 has an inclined shape, when viewed in the width direction, such that a first end thereof is fixed to the pivot shaft 35*a* and a second end thereof is free end so as to guide the sheet S toward the sheet discharge tray 27. Provided at a position facing the sensor flag member 35*b* when viewed from an axial direction of the pivot shaft 35*a* is the sensor 37 provided on the apparatus body to detect a pivot motion of the flag member 35. The sensor 37 is provided at a position where a light emitting component not illustrated faces a photosensitive portion not illustrated for example and uses a photo interrupter that varies an output value in response to the light transmitting state or the light shielding state of the light emitting component and the photosensitive portion. As illustrated in FIG. 4B, the sensor 37 is put in the light transmitting state when the flag member 35 does not pivot. When the flag member 35 pivots as illustrated in FIG. 4C, the sensor 37 is put in the light shielding state as the sensor flag member 35*b* is positioned between the light emitting component and the photosensitive portion. The control portion 200 of the present exemplary embodiment (see FIG. 1) determines that there is a sheet when the output value of the sensor 37 indicates the light shielding state and determines that there is no sheet when the output value indicates the light transmitting state. Note that it is also possible to arrange such that the control portion 200 determines that there is a sheet when the sensor 37 indicates the light transmitting state and determines that there is no sheet when the sensor 37 indicates the light shielding state.

Figure 5A:
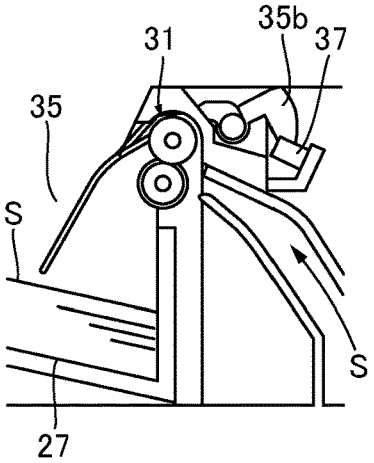
FIG. 5A is a section view illustrating a state in which the sheet has not arrived yet at the sheet discharge roller pair and the flag member is located at a standby position.
Figure 5B:
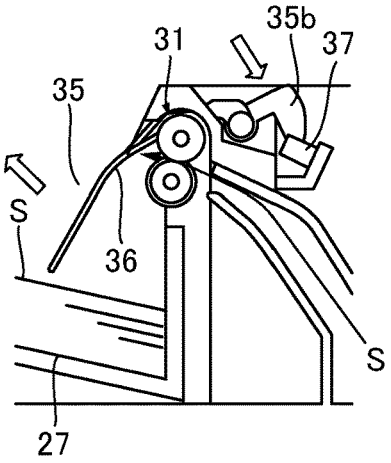
FIG. 5B is a section view illustrating a state in which the sheet conveyed from the sheet discharge roller pair has arrived at the flag member and a downstream end of the sheet is in contact with a flag portion of the flag member.
Figure 5C:
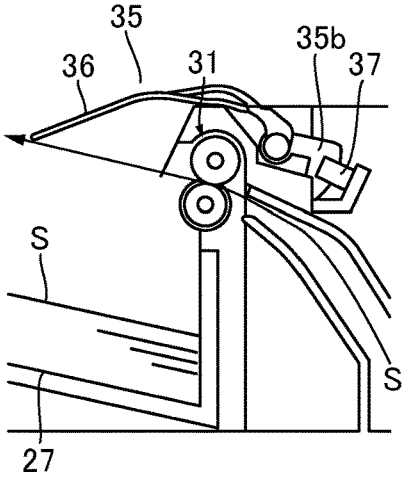
FIG. 5C is a section view illustrating a state in which the sheet is discharged out of the sheet discharge roller pair, the flag member is pivoted by the sheet and a sensor is in the light shielding state.
Figure 5D:
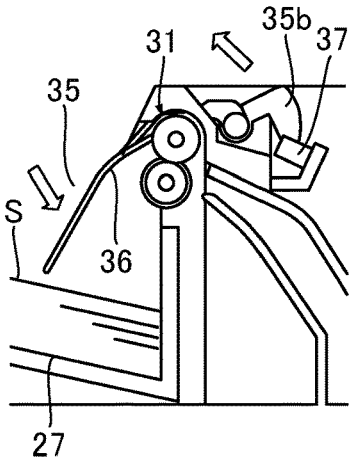
FIG. 5D is a section view illustrating a state in which the sheet discharged out of the sheet discharge roller pair is discharged onto the sheet discharge tray.
Figure 5E:
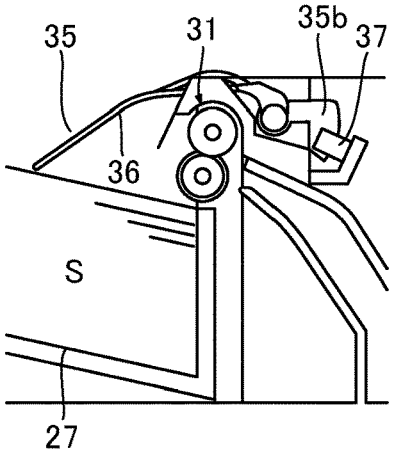
FIG. 5E is a section view illustrating a state in which an uppermost sheet stacked on the sheet discharge tray comes into contact with a free end of the flag portion and in which the sensor is in the light shielding state.

Next, an operation of the flag member 35 will be described with reference to FIGS. 5A through 5E. FIGS. 5A through 5E illustrate, sequentially alphabetically, phases of the operation in discharging the sheet S to the sheet discharge tray 27 by the sheet discharge roller pair 31. FIG. 5A illustrates a phase in which the sheet S has not arrived at the sheet discharge roller pair 31 and the flag member 35 is located at a standby position. FIG. 5B illustrates a phase in which the sheet S conveyed by the sheet discharge roller pair 31 has arrived at the flag member 35 and a downstream end of the sheet S is in contact with the flag portion 36 of the flag member 35. FIG. 5C illustrates a phase in which the flag member 35 is pivoted by the sheet S and the sensor 37 is put in the light shielding state. FIG. 5D illustrates a phase in which the sheet S which has discharged out of the sheet discharge roller pair 31 is discharged onto the sheet discharge tray 27. FIG. 5E illustrates a phase in which an uppermost sheet S stacked on the sheet discharge tray 27 is in contact with the free end of the flag portion 36 and the sensor 37 is put into the light shielding state.

As illustrated in FIG. 5A, because the flag member 35 does not pivot when the sheet S has not arrived at the sheet discharge roller pair 31, the sensor 37 is put in the light transmitting state. As the sheet S conveyed by the sheet discharge roller pair 31 is conveyed further from the state in contact with the flag portion 36, the sheet S pushes up the flag portion 36 while being in sliding contact with the flag portion 36 as illustrated in FIG. 5B. Thereby, the flag member 35 pivots and starts to move from the standby position. Then, as illustrated in FIG. 5C, as the sheet S is conveyed by the sheet discharge roller pair 31 and pushes up the flag portion 36, the flag member 35 pivots and the sensor 37 is put into the light shielding state by the sensor flag member 35*b*. The control portion 200 determines that the sheet S is located at the flag member 35 when the sensor 37 is put into the light shielding state. As illustrated in FIG. 5D, when the sheet S is conveyed further from the phase in FIG. 5C and an upstream end of the sheet S passes through the sheet discharge roller pair 31, the flag portion 36 is not pushed up by the sheet S. Thereby, the flag member 35 pivots to the standby position and returns to the same state with that illustrated in FIG. 5A. Note that there is a case where the flag member 35 does not pivot until when the uppermost sheet S stacked on the sheet discharge tray 27 comes into contact with free end of the flag portion 36 and the sensor 37 is put into the light transmitting state by the sensor flag member 35*b*. At this time, the control portion 200 (see FIG. 1) determines that sheets S of an upper loading limit of the sheet discharge tray 27 have been stacked and stops to discharge the sheet S onto the sheet discharge tray 27 by stopping to drive the actuator 210.

Figure 6A:
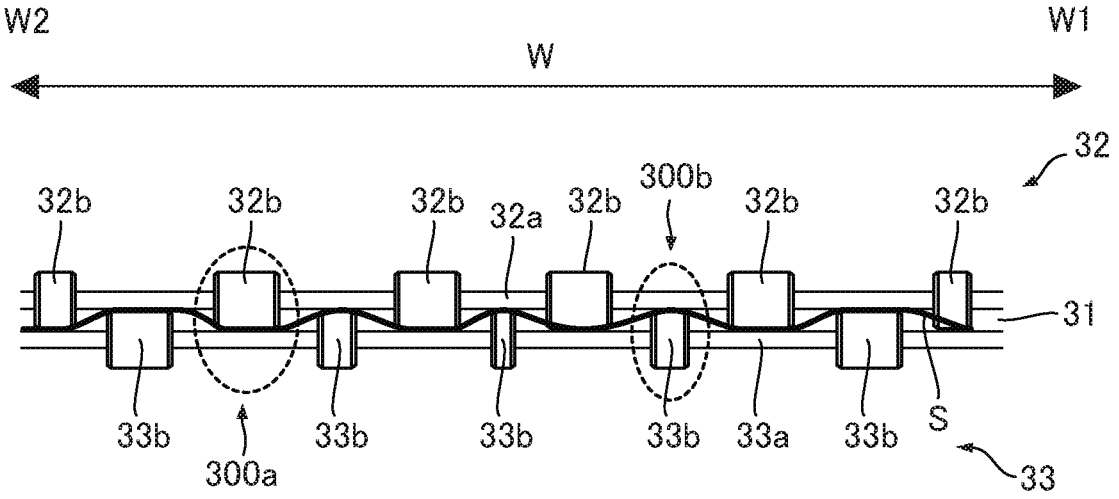
FIG. 6A illustrates the sheet discharge roller pair.
Figure 6B:
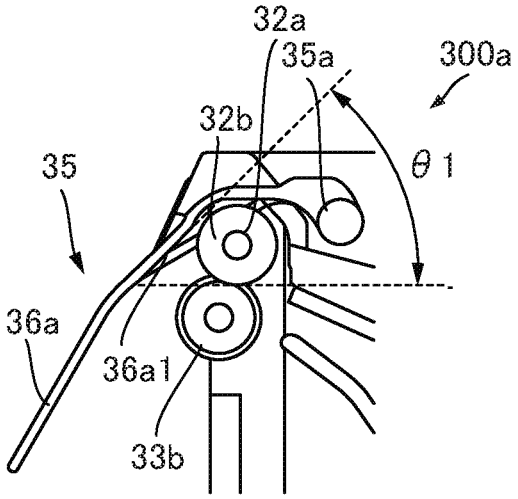
FIG. 6B is a section view illustrating the flag portion located in a first region.
Figure 6C:
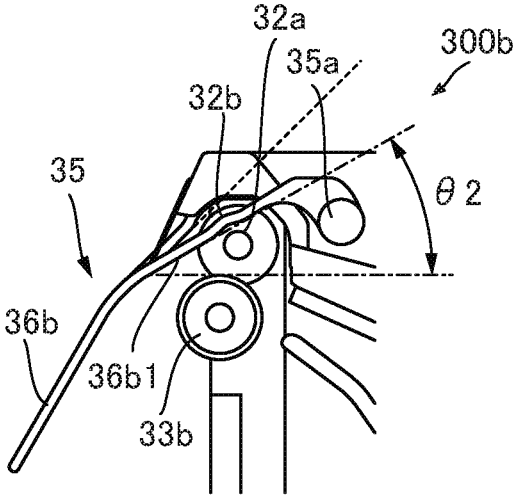
FIG. 6C is a section view illustrating the flag portion located in a second region.

Next, the plurality of flag portions 36, i.e., flag portions 36*a* and 36*b*, provided in the flag member 35 will be described with reference to FIGS. 6A through 6C. FIG. 6A is a plan view illustrating the sheet discharge roller pair 31 constituted of the discharge upper and lower roller portions 32 and 33. FIG. 6B is a section view illustrating the flag portion 36*a* located in a region 300*a* where a first roller 32*b* is located when viewed from the discharge direction. FIG. 6C is a section view illustrating the flag portion 36*b* located at a region 300*b* where a second roller 33*b* is located when viewed from the discharge direction. Note that in FIG. 6A, a width direction orthogonal to the discharge direction of the sheet S discharged out of the sheet discharge roller pair 31 is indicated as a direction W. Still further, a direction indicated by the direction W when viewed such that W1 indicates the front side and W2 indicates the back side is a sight direction when viewed in the width direction. Still further, the direction W which is the sight direction when viewed in the width direction is also a sight direction in parallel with the axial direction of the first pivot shaft 32*a* in FIGS. 6B and 6C as described also in the description of FIG. 3. The flag member 35 is provided with the flag portion 36 having an inclined guide surface toward the sheet discharge tray 27 when viewed in the direction orthogonal to the discharge direction of the sheet S discharged out of the sheet discharge roller pair 31, i.e., when viewed in the width direction. The downstream end of the sheet S conveyed from the sheet discharge roller pair 31 is dropped onto the sheet discharge tray 27 by coming into contact with the flag portion 36. The flag portion 36 includes the flag portion 36*a* disposed in the region 300*a* and the flag portion 36*b* disposed in the region 300*b*. A first flag portion of the present exemplary embodiment is the flag portion 36*a* and a second flag portion is the flag portion 36*b*.

As illustrated in FIG. 6B, the flag portion 36*a* is disposed so as to be able to come into contact with the sheet S in the region 300*a* (see FIG. 6A) where the first roller 32*b* is located when viewed in the discharge direction. The first region of the present exemplary embodiment refers to the region 300*a* where the first roller 32*b* is disposed widthwise. Still further, the flag portion 36*a* includes a guide surface 36*a*1 that guides the sheet S toward the sheet discharge tray 27 at a position where the first roller 32*b* does not overlap with the second roller 33*b* when viewed in the width direction. Thus, the guide surface 36*a*1 serving as a first guide surface of the present exemplary embodiment is disposed such that the first roller 32*b* does not come into contact with the flag portion 36*a*. As illustrated in FIG. 6C, the flag portion 36*b* is disposed so as to be able to come into contact with the sheet S in the region 300*b* (see FIG. 6A) where the second roller 33*b* is located when viewed in the discharge direction. The second region of the present exemplary embodiment refers to the region 300*b* where the second roller 33*b* is disposed widthwise.

The flag portion 36*b* also includes a guide surface 36*b*1 disposed at a position overlapping with the first roller 32*b* and not overlapping with the second roller 33*b* when viewed in the width direction and guiding the sheet S toward the sheet discharge tray 27. The second guide surface of the present exemplary embodiment refers to the guide surface 36*b*1. As illustrated in FIGS. 6B and 6C, if an inclination angle θ1 formed between the guide surface 36*a*1 and a horizontal plane when viewed in the width direction is compared with an inclination angle θ2 formed between the guide surface 36*b*1 and the horizontal plane is compared, the inclination angle θ2 is smaller than the inclination angle θ1. A third angle of the present exemplary embodiment is the inclination angle θ1 and a fourth angle is the inclination angle θ2. The respective end portions on the side not fixed to the pivot shaft 35*a* of the flag portions 36*a* and 36*b* are disposed such their heights when viewed in the width direction are equalized.

Figure 11A:
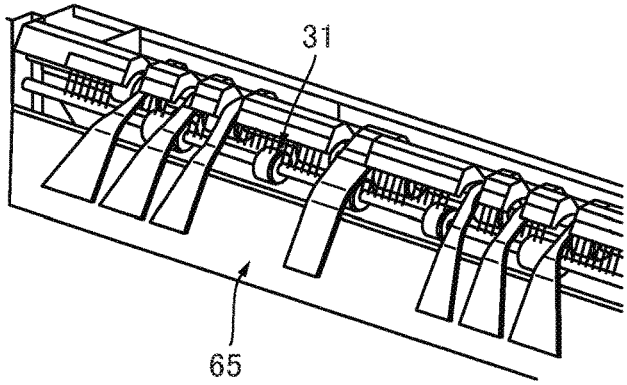
FIG. 11A is a perspective view illustrating a flag member of a reference example.
Figure 11B:
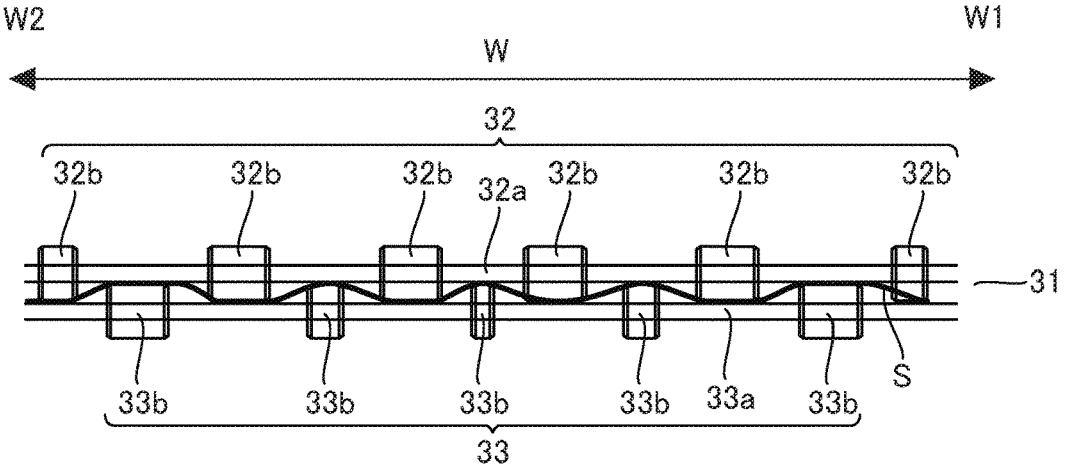
FIG. 11B is a plan view illustrating the sheet discharge roller pair.
Figure 11C:
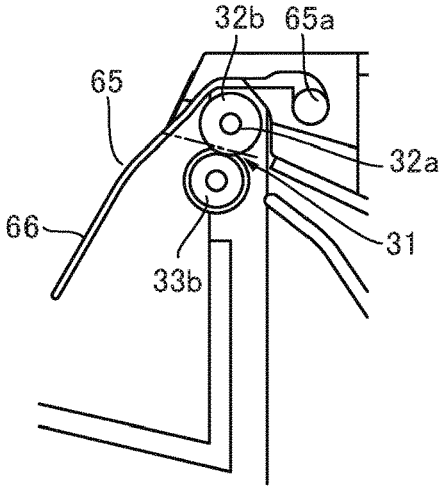
FIG. 11C is a plan view illustrating a positional relationship between the flag member and the sheet discharge roller pair.
Figure 12A:
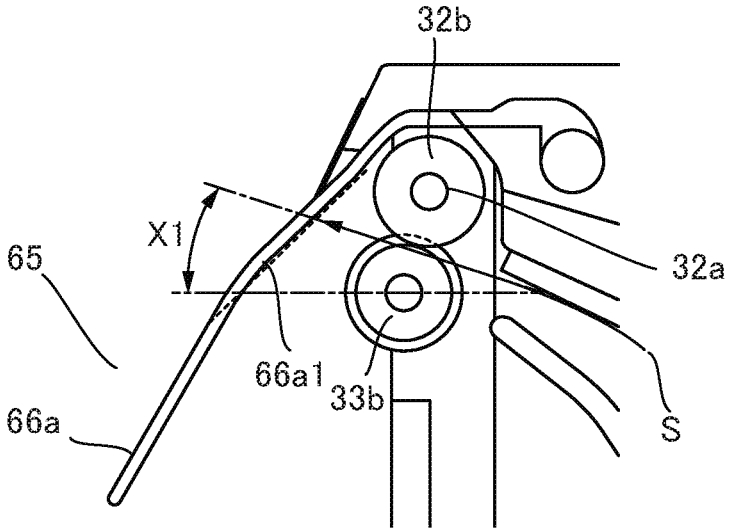
FIG. 12A is a section view illustrating a sheet discharge angle in the first region.
Figure 12B:
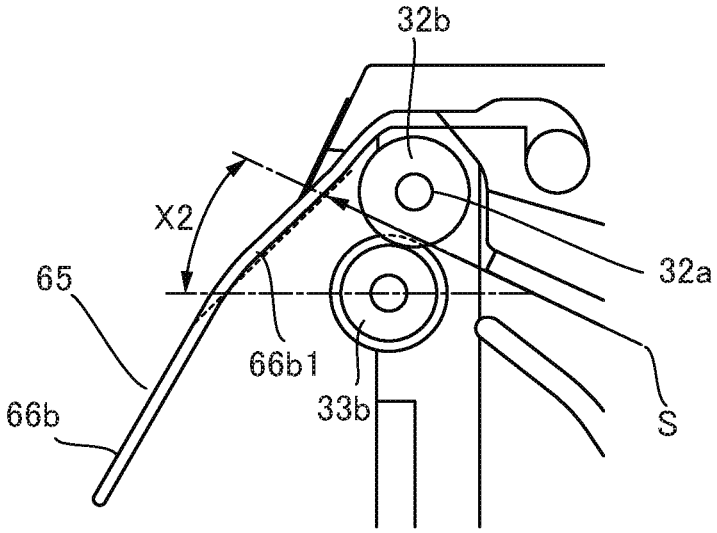
FIG. 12B is a section view illustrating a sheet discharge angle in the second region.

Here, operational effects of the flag member 35 of the present exemplary embodiment will be described with reference to FIGS. 11A to 12B as a reference example. FIG. 11A is a perspective view illustrating a flag member 65 as the reference example, FIG. 11B is a plan view illustrating the sheet discharge roller pair 31 and FIG. 11C is a section view illustrating a positional relationship between the flag member 65 and the sheet discharge roller pair 31. Note that in FIG. 11B, a width direction orthogonal to the discharge direction of the sheet S discharged out of the sheet discharge roller pair 31 of the flag member 65 is indicated as a direction W. Still further, the direction indicated by the direction W when viewed such that W1 indicates the front side and W2 indicates the back side is a sight direction when viewed in the width direction. Still further, the direction W which is the sight direction when viewed in the width direction is a sight direction in parallel with the axial direction of the first pivot shaft 32*a* in FIG. 11C as described also in the description of FIG. 3. Still further, FIG. 12A illustrates a flag portion 66*a* disposed in a first region in the reference example and FIG. 12B illustrates a flag portion 66*b* disposed in a second region in the reference example. The flag member 65 of the reference example includes the flag portions 66*a* and 66*b* (see FIGS. 12A and 12B). The flag portions 66*a* and 66*b* are disposed at positions not overlapping with the first and second rollers 32*b* and 33*b*, respectively when viewed in the width direction and include guide surfaces 66*a*1 and 66*b*1 inclined with a same angle toward the sheet discharge tray 27 (see FIGS. 12A and 12B).

In such arrangement, a position where a sheet tip, i.e., a downstream end, of the sheet S comes into contact with the flag member 65 is different at parts where the sheet S is stiffened by the first roller 32*b* and where the sheet S is stiffened by the second roller 33*b*. That is, positions where the downstream end of the sheet S comes into contact with the flag member 65 are different in the regions 300*a* and 300*b*. As illustrated in FIGS. 12A and 12B, a discharge angle X2 of the second region is greater than a discharge angle X1 of the first region. It is because the sheet S is pushed up by the second roller 33*b* and the sheet S is discharged more upward at the part where a force is applied to the sheet S by the second roller 33*b*. When viewed in the width direction, the sheet S comes into contact with the flag member 65 first in the second region before the first region. Due to that, because the discharge angle X2 of the sheet S in the second region is greater than that in the first region when the sheet S comes into contact with the flag portion 36, an impact applied to the downstream end of the sheet S becomes great. The impact applied to the downstream end of the sheet S may cause flaws on the sheet S or may increase an impact noise generated when the sheet S comes into contact with the flag.

Figure 7A:
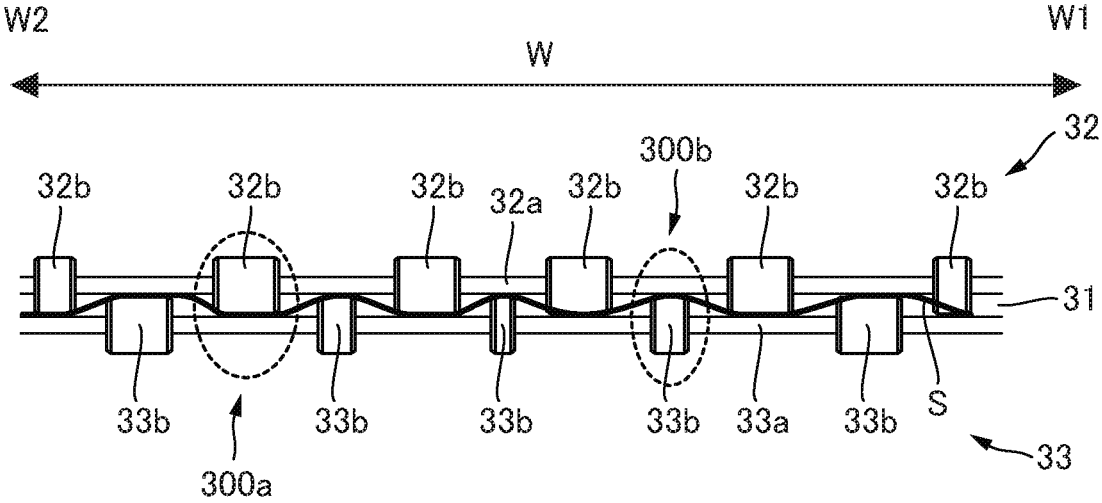
FIG. 7A illustrates the sheet discharge roller pair.
Figure 7B:
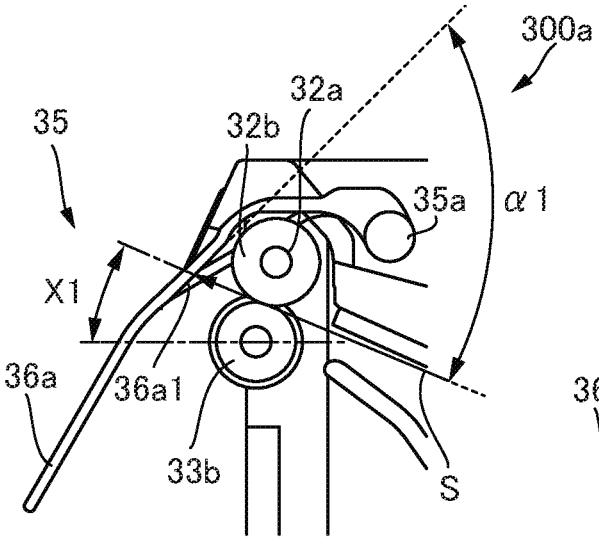
FIG. 7B illustrates a contact angle in the first region.
Figure 7C:
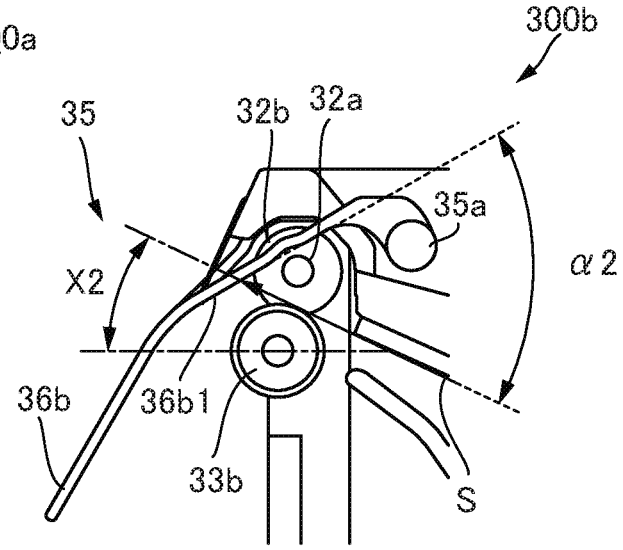
FIG. 7C illustrates a contact angle in the second region.

The guide surfaces 36*a*1 and 36*b*1 are formed into the shapes as described in FIGS. 6B and 6C in the present exemplary embodiment by making reference to the above reference example. FIG. 7A illustrates the sheet discharge roller pair 31 composed of the discharge upper and lower roller portions 32 and 33. FIG. 7B illustrates a contact angle $\alpha$1 of the sheet S in the first region and FIG. 7C illustrates a contact angle $\alpha$2 of the sheet S in the region 300*b*. Note that in FIG. 7A, a width direction orthogonal to the discharge direction of the sheet S discharged out of the sheet discharge roller pair 31 is indicated as a direction W. Still further, a direction indicated by the direction W when viewed such that W1 indicates the front side and W2 indicates the back side is a sight direction when viewed in the width direction. Still further, the direction W which is the sight direction when viewed in the width direction is also a sight direction in parallel with the axial direction of the first pivot shaft 32*a* in FIGS. 7B and 7C as described also in the description with reference to FIG. 3. Here, in a case where the flag member 35 is located at the standby position, an angle formed by a tangential line, at a contact point of the sheet S discharged out of the region 300*a* and the first roller 32*b*, and the guide surface 36*a*1 is defined as the contact angle $\alpha$1. Still further, in a case where the flag member 35 is located at the standby position, an angle formed by a tangential line, at a contact point of the sheet S discharged out of the region 300*b* and the second roller 33*b*, and the guide surface 36*b*1 is defined as the contact angle $\alpha$2. A first angle of the present exemplary embodiment is the contact angle $\alpha$1 and a second angle is the contact angle $\alpha$2. As illustrated in FIGS. 7B and 7C, positions where the tip of the sheet S, i.e., the downstream end of the sheet S, comes into contact with the flag member 35, are different in the regions 300*a* and 300*b*. As illustrated in FIGS. 7B and 7C, the discharge angle X2 in the region 300*b* is greater than the discharge angle X1 in the region 300*a*. It is because the sheet S is pushed up by the second roller 33*b* and the sheet S is discharged more upward at the part where the force is applied to the sheet S by the second roller 33*b* in the same manner with the reference example. However, the inclination angles of the guide surfaces 36*a*1 and 36*b*1, i.e., the inclination angles $\theta$1 and $\theta$2, are set respectively such that contact angle $\alpha 1$>contact angle $\alpha$2 in the present exemplary embodiment.

By arranging as described above, the discharged sheet S is pushed up by the second roller 33*b* and the discharge angle X2 of the sheet S with respect to the horizontal plane becomes large in the region 300*b* as illustrated in FIG. 7C. However, because the contact angle $\alpha$2 when the downstream end of the sheet S comes into contact with the guide surface 36*b*1 is smaller than the contact angle $\alpha$1, an impact applied to the downstream end of the sheet S becomes smaller than that when the downstream end of the sheet S in the region 300*a* comes into contact with the guide surface 36*a*1. This arrangement makes it possible to suppress flaws from being otherwise caused by the impact applied to the downstream end of the sheet S or a large impact noise from being otherwise generated when the downstream end of the sheet comes into contact with the flag. It is also possible to detect the sheets S stacked closely to the sheet discharge roller pair 31 on the sheet discharge tray 27 by the flag portions 36*a* and 36*b* and to prevent a sheet jam from being otherwise generated by the sheet S.

Still further, when FIG. 7C is compared with FIG. 7B, the sheet S comes into contact with the flag portion 36*a* in the region 300*a* after coming into contact with the flag portion 36*b* in the region 300*b* when viewed in the width direction. Accordingly, because the flag member 35 pivots slightly as the sheet S comes into contact with the flag portion 36*b*, the flag member 35 is put into a state in which the flag member 35 has moved from the standby position when the sheet S comes into contact with the flag portion 36*a* in the region 300*a*. Thereby, the inclination angle $\theta$1 of the guide surface 36*a*1 with respect to the horizontal plane becomes larger than a case where the flag member 35 is located at the standby position. At this time, the contact angle $\alpha$1 becomes smaller than a case where the flag member 35 is located at the standby position in the first region 300*a*. That is, because a resistance given to the downstream end of the sheet S becomes small in the region 300*a*, it is possible to suppress the flaws from otherwise caused at the downstream end of the sheet S and to suppress the large contact noise from otherwise being generated.

Note that although both of the flag portions 36*a* and 36*b* pivot on an axis of the pivot shaft 35*a* in the present exemplary embodiment, the flag portions 36*a* and 36*b* may be provided around another axis depending on the structure of the apparatus body 100A. Still further, if the contact angle of the sheet S discharged out of the sheet discharge roller pair 31 is equal to or less than 90°, it is preferable to drop the sheet S onto the sheet discharge tray 27. Still further, if the contact angle of the sheet S discharged out of the sheet discharge roller pair 31 is equal to or less than 45°, it is preferable to prevent flaws from being otherwise caused at the downstream end of the sheet S.

Second Embodiment

Next, a second exemplary embodiment of the present disclosure will be described with reference to FIGS. 8A and 8B. The present exemplary embodiment is different from the first exemplary embodiment in that the discharge portion is constituted of discharge upper and lower roller portions 32 and 33 and a stiffening member 51. Note that same component parts with those of the first exemplary embodiment will be denoted by same reference signs and an overlapped description will be omitted in the description of the present exemplary embodiment.

Figure 8A:
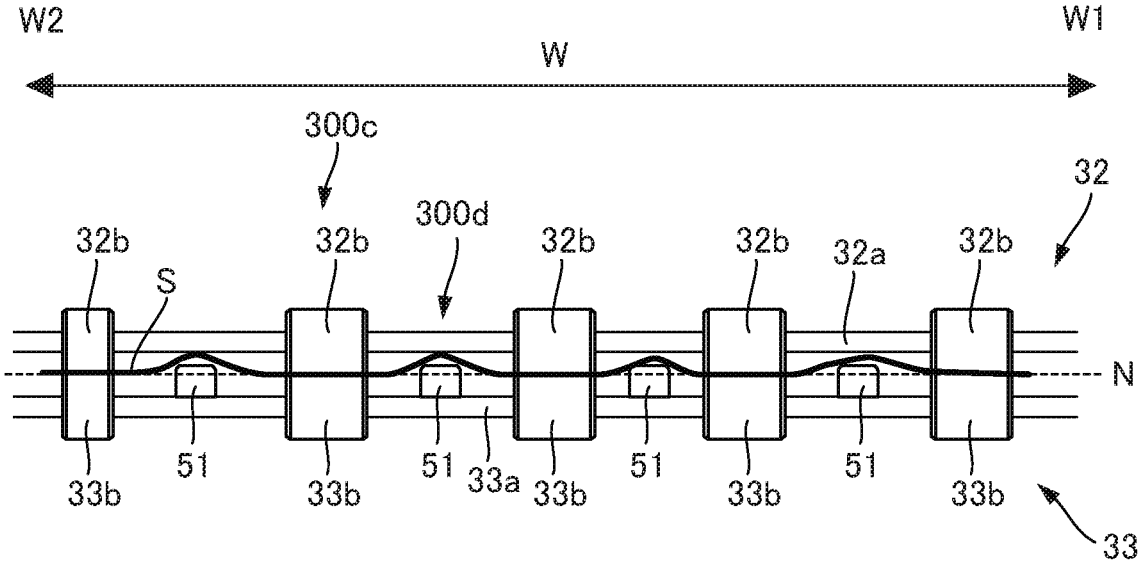
FIG. 8A illustrates dispositions of a discharge upper and lower roller portions and a stiffening member of a second exemplary embodiment.
Figure 8B:
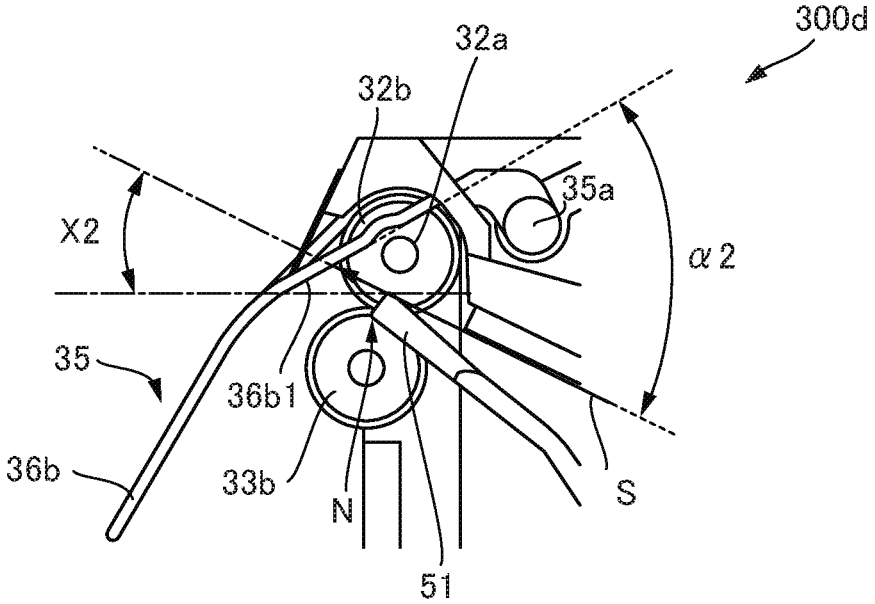
FIG. 8B illustrates a contact angle in the second region.

Configurations of Discharge Upper and Lower Roller Portions and Stiffening Member FIG. 8A illustrates dispositions of the discharge upper and lower roller portions 32 and 33 and the stiffening member 51 of the present exemplary embodiment and FIG. 8B illustrates a contact angle α2 of the sheet S in a region 300*d* of the present exemplary embodiment. Note that in FIG. 8A, a width direction orthogonal to the discharge direction of the sheet S discharged out of the sheet discharge roller pair 31 is indicated as a direction W. Still further, a direction indicated by the direction W when viewed such that W1 indicates the front side and W2 indicates the back side is a sight direction when viewed in the width direction. Still further, the direction W which is the sight direction when viewed in the width direction is also a sight direction in parallel with the axial direction of the first pivot shaft 32*a* in FIG. 8B as described also in the description of FIG. 3. As illustrated in FIG. 8A, a first roller 32*b* serving as a fourth roller of the present exemplary embodiment and a second roller 33*b* serving as a fifth roller are disposed at positions facing each other when viewed in the discharge direction, and a nip portion N is formed by the first and second rollers 32*b* and 33*b*. The first roller 32*b* includes an outer circumferential surface coming into contact with the sheet S from an upper surface of the sheet S in a region 300*c* and the second roller 33*b* includes an outer circumferential surface coming into contact with the sheet S from a lower surface of the sheet S in the region 300*c*. As illustrated in FIG. 8A, the stiffening member 51 serving as a second member of the present exemplary embodiment is disposed at a position different from the nip portion N formed by the first and second rollers 32*b* and 33*b* when viewed in the discharge direction. As illustrated in FIG. 8B, the stiffening member 51 is disposed such that the stiffening member 51 crosses from a lower side to an upper side of the nip portion N when viewed in the width direction. The sheet S is pushed up above the nip portion N by the stiffening member 51 and thereby, the sheet S is discharged out of the apparatus body 100A (see FIG. 1) while being wavily flexed.

The flag member 35 is constructed and disposed in the same manner with that of the first exemplary embodiment. However, a plurality of flag portions 36 is composed of flag portions 36*a* in which first and second rollers 32*b* and 33*b* are disposed in a certain region when viewed in the discharge direction and flag portions 36*b* in which the stiffening member 51 is disposed in a certain region when viewed in the discharge direction. A first region of the present exemplary embodiment is the region 300*c* in which the first and second rollers 32*b* and 33*b* are disposed when viewed in the discharge direction and a second region is a region 300*d* in which the stiffening member 51 is disposed when viewed in the discharge direction. Note that in the present exemplary embodiment, the flag portion disposed in the region 300*c* is formed into the same shape with the flag portion 36*a* (see FIG. 6B) disposed in the region 300*a* of the first exemplary embodiment.

FIG. 8B is a section view illustrating a position where the flag portion 36*b* of the present exemplary embodiment is disposed. As described above, the sheet S that comes into contact with the stiffening member 51 in the region 300*d* is pushed up above the nip portion N by the stiffening member 51, so that a discharge angle X2 increases. Here, in a case where the flag member 35 is located at the standby position, an angle formed by a tangential line, at a contact point of the sheet S discharged out of the region 300*d* and the stiffening member 51, and the guide surface 36*b*1 is defined as the contact angle α2. Similarly to the first exemplary embodiment, a discharge angle X2 in the region 300*d* is greater than a discharge angle X in the region 300*d* also in the present exemplary embodiment. A first angle of the present exemplary embodiment is an angle formed by the tangential line, at the contact point of the sheet S discharged out of the region 300*c* and the nip portion N, and the guide surface 36*a*1 of the flag portion 36*a* (see FIG. 6B) and a second angle is the contact angle α2 in the case where the flag member 35 is located at the standby position. It is because the sheet S is pushed up by the stiffening member 51 and the sheet S is discharged above the nip portion N at the part where the force is applied to the sheet S by the stiffening member 51. However, the contact angle α2 is made smaller than the angle formed by the tangential line, at the contact point of the sheet S discharged out of the region 300*c* and the first roller 32*b*, and the guide surface 36*a*1 (see FIG. 6B) in the case where the flag member 35 is located at the standby position in the present exemplary embodiment. That is, an inclination angle θ2 formed by the horizontal plane and the guide surface 36*b*1 is set to be smaller than an inclination angle formed by the guide surface 36*a*1 (see FIG. 6B) and the horizontal plane. A third angle of the present exemplary embodiment is the angle formed between the horizontal plane and the guide surface 36*a*1 (see FIG. 6B), and a fourth angle is the inclination angle θ2.

By arranging as described above, the discharged sheet S is pushed up by the stiffening member 51 more than the nip portion N and the discharge angle X2 of the sheet S with respect to the horizontal plane becomes large in the region 300*d* as illustrated in FIG. 8B. However, because the contact angle α2 when the downstream end of the sheet S comes into contact with the guide surface 36*b*1 is small, an impact applied to the downstream end of the sheet S becomes smaller than that when the downstream end of the sheet S in the region 300*a* comes into contact with the flag portion of the flag member 35. This arrangement makes it possible to suppress flaws otherwise caused on the sheet S or a large impact noise otherwise generated by the impact applied to the downstream end of the sheet S when the downstream end of the sheet comes into contact with the flag. It is also possible to detect the sheets S stacked closely to the first and second rollers 32*b* and 33*b* on the sheet discharge tray 27 and to prevent a sheet jam from otherwise caused by the sheet S.

Still further, the sheet S comes into contact with the flag member 35 in the region 300*c* after coming into contact with the flag portion 36*b* in the region 300*d* similarly to the first exemplary embodiment. Accordingly, because the flag member 35 pivots slightly as the sheet S comes into contact with the flag portion 36*b*, the flag member 35 is put into a state in which the flag member 35 has moved from the standby position when the sheet S comes into contact with the flag portion in the region 300*c*. Thereby, a resistance applied to the downstream end of the sheet S becomes small also in the region 300*c* similarly to the first exemplary embodiment, it is possible to suppress the flaws from otherwise caused at the downstream end of the sheet S and to suppress the large contact noise from otherwise being generated.

Third Embodiment

Next, a third exemplary embodiment of the present disclosure will be described with reference to FIGS. 9A through 9C. The present exemplary embodiment is different from the first and second exemplary embodiments in that a contact portion is constituted of a sheet member 52. Note that same component parts with those of the first and second exemplary embodiments will be denoted by same reference signs and an overlapped description will be omitted in the description of the present exemplary embodiment.

Configuration of Sheet Member

Figure 9A:
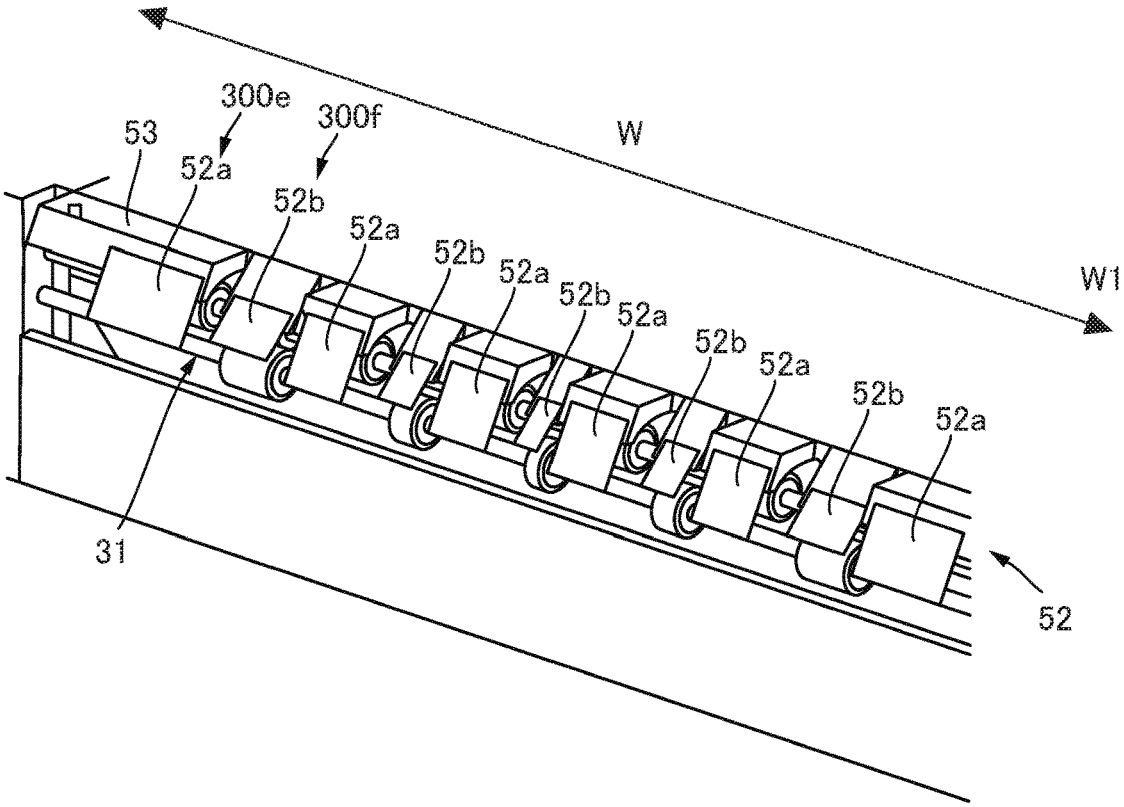
FIG. 9A is a perspective view illustrating a sheet member of a third exemplary embodiment.
Figure 9B:
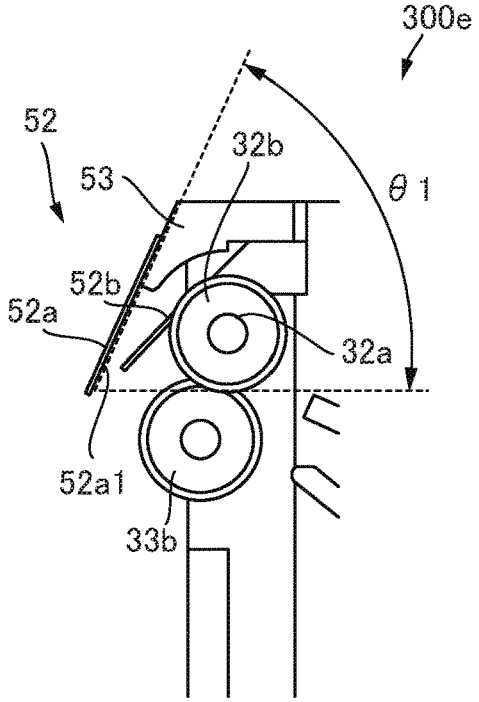
FIG. 9B is a section view illustrating the flag portion in the first region.
Figure 9C:
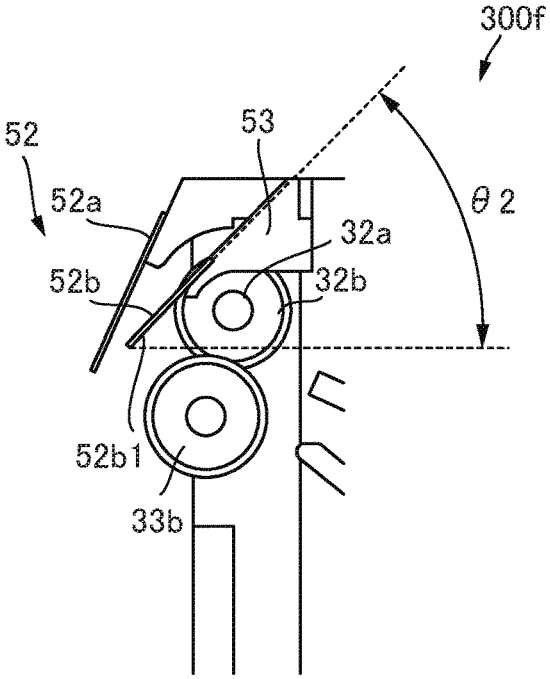
FIG. 9C is a section view illustrating the flag portion in the second region.

FIG. 9A is a perspective view illustrating a configuration of the sheet member 52 of the present exemplary embodiment, FIG. 9B is a section view illustrating the flag portions 52*a* and 52*b* in a region 300*e* of the present exemplary embodiment, and FIG. 9C is a section view illustrating the flag portions 52*a* and 52*b* in a region 300*f* of the present exemplary embodiment. Note that in FIG. 9A, a width direction orthogonal to the discharge direction of the sheet S discharged out of the sheet discharge roller pair 31 is indicated as a direction W. Still further, a direction indicated by the direction W when viewed such that W1 indicates the front side and W2 indicates the back side is a sight direction when viewed in the width direction. Still further, the direction W which is the sight direction when viewed in the width direction is also a sight direction in parallel with the axial direction of the first pivot shaft 32*a* in FIGS. 9B and 9C as described also in the description of FIG. 3. The sheet member 52 is an elastic member made of resin such as polyester for example that comes into contact with the sheet S and is elastically deformed by being pressed by the sheet. The sheet member 52 is provided on a guide member 53 fixed to the apparatus body 100A (see FIG. 1) as illustrated in FIG. 9A. The sheet member 52 drops the sheet S onto the sheet discharge tray 27 by coming into contact with the sheet S. A flag portion 52*a* serving as a third flag portion of the present exemplary embodiment is disposed such that one end (a first end) thereof is fixed to the guide member 53 so as to be contactable with the sheet S in a region 300*e* in which the first roller 32*b* is located when viewed in the discharge direction. A first region of the present exemplary embodiment refers to the region 300*e* where the first roller 32*b* is disposed when viewed in the width direction. Still further, the flag portion 52*a* includes a guide surface 52*a*1 that is disposed at a position not overlapping with the first and second rollers 32*b* and 33*b* when viewed in the width direction and that guides the sheet S toward the sheet discharge tray 27. Thus, the guide surface 52*a*1 serving as a first guide surface of the present exemplary embodiment is disposed so as not come into contact with the first roller 32*b* and the flag portion 36*a*. The flag portion 52*b* serving as a fourth flag portion of the present exemplary embodiment is disposed such one end (a first end) thereof is fixed to the guide member 53 and so as to be contactable with the sheet S in a region f (see FIG. 9A) in which the second roller 33*b* is located as illustrated in FIG. 9C. A second region of the present exemplary embodiment refers to the region 300*f* in which the second roller 33*b* is disposed in the width direction.

The flag portion 52*b* also includes a guide surface 52*b*1 that is disposed at a position overlapping with the first roller 32*b* when viewed in the width direction and at a position not overlapping with the second roller 33*b* and that guides the sheet S toward the sheet discharge tray 27. A second guide surface of the present exemplary embodiment refers to the guide surface 52*b*1. As illustrated in FIGS. 9B and 9C, if an inclination angle θ1 formed between the guide surface 52*a*1 and the horizontal plane when viewed in the width direction is compared with an inclination angle θ2 formed between the guide surface 52*b*1 and the horizontal plane is compared, the inclination angle θ2 is smaller than the inclination angle θ1. A third angle of the present exemplary embodiment is the inclination angle θ1 and a fourth angle is the inclination angle θ2. The respective end portions on the side not fixed to the guide member 53 of the flag portions 52*a* and 52*b* are disposed such their heights, when viewed in the width direction, become such the end portion of the flag portion 52*b* is higher than the end portion of the flag portion 52*a*.

Figure 10A:
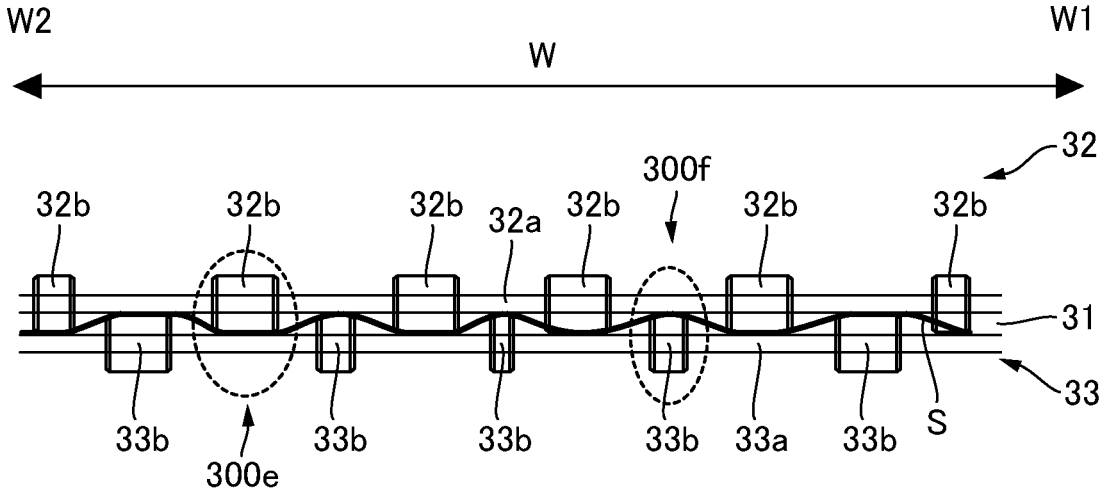
FIG. 10A is a plan view illustrating the sheet discharge roller pair of the third exemplary embodiment.
Figure 10B:
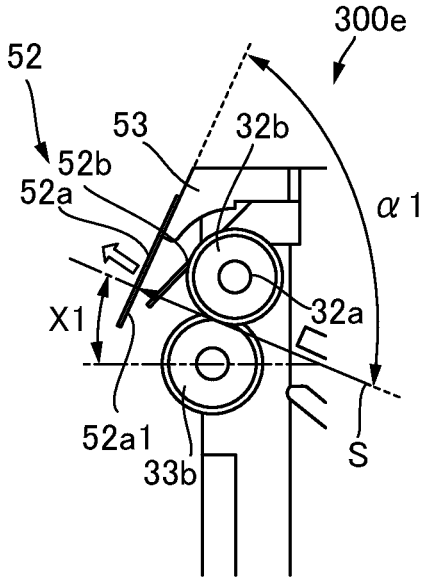
FIG. 10B illustrates a contact angle in the first region.
Figure 10C:
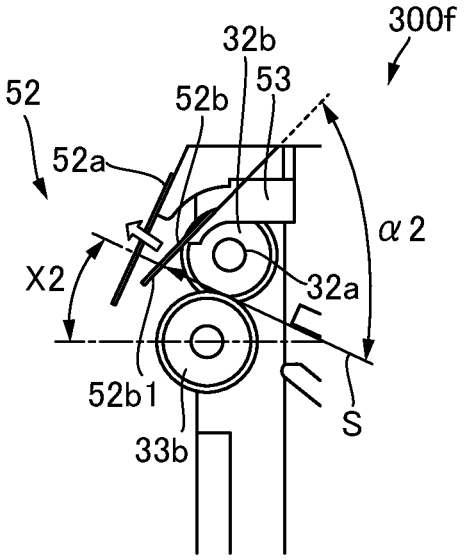
FIG. 10C is a contact angle in the second region.

As illustrated in FIGS. 10A through 10C, contact angles of the sheet are different in the region 300*e* where the first roller 32*b* is disposed and in the region 300*f* where the second roller 33*b* is disposed when the sheet S wavily flexed is discharged in the present exemplary embodiment. FIG. 10A is a plan view illustrating the sheet discharge roller pair 31 composed of the discharge upper and lower roller portions 32 and 33, FIG. 10B illustrates a contact angle α1 of the sheet S in the region 300*e* and FIG. 10C illustrates a contact angle α2 of the sheet S in the region 300*f*. Note that in FIG. 10A, a width direction orthogonal to the discharge direction of the sheet S discharged out of the sheet discharge roller pair 31 is indicated as a direction W. Still further, a direction indicated by the direction W when viewed such that W1 indicates the front side and W2 indicates the back side is a sight direction when viewed in the width direction. Still further, the direction W which is the sight direction when viewed in the width direction is also a sight direction in parallel with the axial direction of the first pivot shaft 32*a* in FIGS. 10B and 10C as described also in the description of FIG. 3. Here, an angle formed by a tangential line, at a contact point of the sheet S discharged out of the region 300*e* and the first roller 32*b*, and the guide surface 52*a*1 is defined as the contact angle α1. Still further, an angle formed by a tangential line, at a contact point of the sheet S discharged out of the region 300*f* and the second roller 33*b*, and the guide surface 52*b*1 is defined as the contact angle α2. A first angle of the present exemplary embodiment is the contact angle α1 and a second angle is the contact angle α2. As illustrated in FIGS. 10B and 10C, a position where a tip of the sheet S, i.e., the downstream end of the sheet S, comes into contact with the sheet member 52, is different in the regions 300*e* and 300*f*. As illustrated in FIGS. 10B and 10C, a discharge angle X2 in the region 300*f* is greater than a discharge angle X1 in the region 300*e*. It is because the sheet S is pushed up by the second roller 33*b* and the sheet S is discharged more upward at the position where the force is applied to the sheet S by the second roller 33*b* similarly to the reference example. In contrary, the inclination angles of the guide surfaces 52*a*1 and 52*b*1, i.e., the inclination angles θ1 and θ2, are set respectively such that contact angle α1>contact angle α2 in the present exemplary embodiment.

By arranging as described above, the discharged sheet S is pushed up by the second roller 33*b* and the discharge angle X2 of the sheet S with respect to the horizontal plane becomes large in the region 300*f* as illustrated in FIG. 10C. However, because the contact angle α2 formed when the downstream end of the sheet S comes into contact with the guide surface 52*b*1 is smaller than the contact angle α1, an impact applied to the downstream end of the sheet S becomes smaller than that formed when the downstream end of the sheet S in the region 300*e* comes into contact with the guide surface 52*a*1. This arrangement makes it possible to suppress flaws from being otherwise caused by the impact applied to the downstream end of the sheet S or a large impact noise from being otherwise generated when the downstream end of the sheet comes into contact with the flag.

Still further, a sheet member 52 of a degree of length that permits to avoid interference with the first roller 32*b* has been used in the past to dispose the sheet member while uniformly reducing the inclination angle of the sheet member. In contrary, according to the configuration of the present exemplary embodiment, the contact angle α2 can be reduced without prolonging the sheet member 52, so that it is not necessary to use the sheet member 52 of a degree of length that permits to avoid the interference with the first roller 32*b*, thus enabling to cut the cost. Note that instead of the sheet discharge roller pair 31 serving as the discharge portion of the present exemplary embodiment, the sheet member 52 of the present exemplary embodiment is applicable in the same manner to the configuration of using the discharge upper and lower roller portions 32 and 33 and the stiffening member 51 as the discharge portion in the second exemplary embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-124830, filed Jul. 3, 2019, which is hereby incorporated by reference herein in its entirety.

What is claimed is:

1. A sheet discharging apparatus, comprising:

a sheet discharge tray onto which a sheet discharged out of an apparatus body is stacked;

a discharge portion configured to discharge the sheet, the discharge portion comprising a first member configured to contact an upper surface of the sheet and apply a force to a first region of the sheet and a second member configured to contact a lower surface of the sheet and apply a force to a second region of the sheet, the second member being disposed at a position different from a position of the first member in a width direction orthogonal to a discharge direction of the sheet such that at least a part of the second member overlaps with the first member when viewed in the width direction; and a contact portion comprising a first guide surface disposed contactably with the first region of the sheet and configured to guide the sheet discharged out of the discharge portion toward the sheet discharge tray and a second guide surface disposed contactably with the second region of the sheet and configured to guide the sheet discharged out of the discharge portion toward the sheet discharge tray, the contact portion being movable from a standby position by being pressed by the sheet, wherein the first guide surface is formed such that an angle of the first guide surface with respect to a tangential line to the first member at a contact point between the first member and the first region of the sheet is a first angle when viewed in the width direction in a state in which the contact portion is located at the standby position, wherein the second guide surface is formed such that an angle of the second guide surface with respect to a tangential line to the second member at a contact point between the second member and the second region of the sheet is a second angle which is smaller than the first angle when viewed in the width direction in a state in which the contact portion is located at the standby position, wherein the first guide surface is provided at a position not overlapping with the first and second members when viewed in the width direction in a state in which the contact portion is located at the standby position, and wherein the second guide surface is provided at a position overlapping with the first member and not overlapping with the second member when viewed in the width direction in a state in which the contact portion is located at the standby position.

2. The sheet discharging apparatus according to claim 1, wherein the contact portion comprises a pivot shaft pivotably supported, a first flag portion including the first guide surface, and a second flag portion including the second guide surface, a first end of the first flag portion being fixed to the pivot shaft, and a first end of the second flag portion being fixed to the pivot shaft, wherein the first flag portion is disposed so as to overlap with the first member when viewed in the discharge direction, and wherein the second flag portion is disposed so as to overlap with the second member when viewed in the discharge direction.

3. The sheet discharging apparatus according to claim 2, further comprising:

a detection portion configured to vary an output value thereof in response to a pivot motion of the pivot shaft; and a control portion configured to stop discharging of the sheet to the sheet discharge tray based on the output value.

4. The sheet discharging apparatus according to claim 1, wherein the contact portion comprises a third flag portion including the first guide surface, and a fourth flag portion including the second guide surface, a first end of the third flag portion being fixed to the apparatus body, and a first end of the fourth flag portion being fixed to the apparatus body, wherein the third flag portion is disposed so as to overlap with the first member when viewed in the discharge direction and is elastically deformable by being pressed by the first region of the sheet, and wherein the fourth flag portion is disposed so as to overlap with the second member when viewed in the discharge direction and is elastically deformable by being pressed by the second region of the sheet.

5. The sheet discharging apparatus according to claim 4, wherein a second end of the fourth flag portion is located above a second end of the third flag portion.

6. The sheet discharging apparatus according to claim 1, wherein the first member is a first roller rotatably supported and an outer circumferential surface thereof comes into contact with the upper surface of the sheet, wherein the second member is a second roller rotatably supported and an outer circumferential surface thereof comes into contact with the lower surface of the sheet, wherein the sheet discharging apparatus further comprises a third roller rotatably supported and disposed such that an outer circumferential surface thereof comes into contact with the upper surface of the sheet on a side opposite from the first roller interposing the second roller in the width direction, and wherein the first, second and third rollers are disposed such that at least a part thereof overlap with each other when viewed in the width direction.

7. The sheet discharging apparatus according to claim 1, wherein the first member is a fourth roller rotatably supported and disposed such that an outer circumferential surface thereof comes into contact with the upper surface of the sheet, wherein the sheet discharging apparatus further comprises a fifth roller that forms a nip portion together with the first member and an outer circumferential surface thereof comes into contact with the lower surface of the sheet, and wherein the second member is a stiffening member disposed so as to cross a tangential line to the fifth roller and the first member at the nip portion from a lower side to an upper side when viewed in the width direction and configured to apply a force to the lower surface of the sheet nipped in the nip portion.

8. An image forming apparatus comprising:

the sheet discharging apparatus as set forth in claim 1; and an image forming unit configured to form an image on a sheet.

9. A sheet discharging apparatus, comprising:

a sheet discharge tray onto which a sheet discharged out of an apparatus body is stacked;

a discharge portion configured to discharge the sheet, the discharge portion comprising a first member configured to contact an upper surface of the sheet and apply a force to a first region of the sheet and a second member configured to contact a lower surface of the sheet and apply a force to a second region of the sheet, the second member being disposed at a position different from a position of the first member in a width direction orthogonal to a discharge direction of the sheet such that at least a part of the second member overlaps with the first member when viewed in the width direction; and a contact portion comprising a first guide surface disposed contactably with the first region of the sheet and configured to guide the sheet discharged out of the discharge portion toward the sheet discharge tray and a second guide surface disposed contactably with the second region of the sheet and configured to guide the sheet discharged out of the discharge portion toward the sheet discharge tray, the contact portion being movable from a standby position by being pressed by the sheet, wherein the first guide surface is formed such that an angle of the first guide surface with respect to a horizontal plane is a third angle when viewed in the width direction in a state in which the contact portion is located at the standby position, wherein the second guide surface is formed such that an angle of the second guide surface with respect to the horizontal plane is a fourth angle which is smaller than the third angle when viewed in the width direction in a state in which the contact portion is located at the standby position, wherein the first guide surface is provided at a position not overlapping with the first and second members when viewed in the width direction in a state in which the contact portion is located at the standby position, and wherein the second guide surface is provided at a position overlapping with the first member and not overlapping with the second member when viewed in the width direction in a state in which the contact portion is located at the standby position.

* * * * *